US008141561B2

(12) United States Patent
Thorpe et al.

(10) Patent No.: US 8,141,561 B2
(45) Date of Patent: Mar. 27, 2012

(54) MASCARA APPLICATORS

(75) Inventors: James Thorpe, London (GB); Manuel Viégas, Brunoy (FR)

(73) Assignee: HCT Europe Limited, London (GB)

( * ) Notice: Subject to any disclaimer, the term of this patent is extended or adjusted under 35 U.S.C. 154(b) by 363 days.

(21) Appl. No.: 12/399,591

(22) Filed: Mar. 6, 2009

(65) Prior Publication Data

US 2010/0224208 A1 Sep. 9, 2010

(51) Int. Cl.
*A45D 40/26* (2006.01)

(52) U.S. Cl. ..... 132/218

(58) Field of Classification Search ..... 132/216–218, 132/318, 320; 401/127, 126, 129, 279; 15/172, 15/188, 207.2, 159.1
See application file for complete search history.

(56) References Cited

U.S. PATENT DOCUMENTS 4,446,880 A 5/1984 Gueret et al.
4,869,612 A * 9/1989 Mooney et al. ..... 401/130
2005/0249539 A1* 11/2005 Habatjou ..... 401/127
2009/0194120 A1 8/2009 Pires et al.
2009/0194127 A1* 8/2009 Pires et al. ..... 132/218

FOREIGN PATENT DOCUMENTS

EP 2084986 A2 8/2009
WO WO9211785(A1) 7/1992
WO WO 2007117091 * 10/2007

* cited by examiner

*Primary Examiner* — Todd Manahan
*Assistant Examiner* — Brianne Kalach
(74) *Attorney, Agent, or Firm* — Lee & Hayes, PLLC

(57) ABSTRACT

A mascara applicator includes a hollow grip portion connected to which is one end of a shaft, the other end of which carries a mascara brush. The shaft and mascara brush are hollow and the mascara brush is flexible. An elongate flexible connector extends within the shaft and the mascara brush. A first end of the connector is fixed with respect to the distal end of the mascara brush and the second end of the connector is fixed with respect to actuating means within the grip portion. The actuating means are selectively operable to move the second end of the connector in the direction away from the mascara brush, thereby applying a force to the distal end of the mascara brush and causing it to adopt a curved configuration.

8 Claims, 4 Drawing Sheets

MASCARA APPLICATORS

FIELD OF THE INVENTION

The present invention relates to mascara applicators, that is to say devices for applying mascara to the eyelashes for cosmetic purposes. Mascara applicators typically include a hollow grip or handle portion, connected to which is one end of a shaft, the other end of which carries a mascara brush. The grip portion is commonly constructed in the form of a cap of a mascara container and for this purpose the shaft carrying the mascara brush is commonly connected to the base of a well formed in one end of the tubular grip portion, the internal surface of the well carrying an internal screw thread intended to engage with an external screw thread on the outer surface of the upper portion of a mascara container, whereby the mascara brush is normally immersed in liquid mascara within the container. When it is desired to apply mascara to the eyelashes, the grip portion is unscrewed from the container and the shaft and mascara brush are removed from the container and the brush is then used to apply the mascara adhering to it to the eyelashes.

DESCRIPTION OF THE PRIOR ART

Conventional mascara brushes are in the form of a generally cylindrical straight rod carrying a plurality of bristles extending radially outwardly from its outer surface. However, straight mascara brushes are not thought by some people to be ideal for all purposes and curved mascara brushes are also known. Thus the eyelashes are curved and the curvature of the brush may at least approximately match the curvature of the lashes so as to facilitate the uniform application of mascara to all the lashes at the same time. Furthermore, if the brush is curved, the spacing of the bristles on the outside of the curvature will inherently be greater than that of the bristles on the inside of the curvature and the use of the bristles with a greater spacing to apply mascara will result in the lashes penetrating more deeply into the brush which results in the application of a greater amount of mascara to the lashes, thereby producing a so-called "volumising" effect. Furthermore, twisting a curved mascara brush upward into the lashes exerts greater pressure on the lashes, thereby creating a curling effect on the lashes, which is considered to enhance the attractiveness of the lashes.

However, some people like to use a straight mascara brush at some times or for certain specific purposes and a curved mascara brush at other times or for different specific purposes and this currently necessitates their possessing two different mascara applicators. It is therefore the object of the invention to provide a mascara applicator on which the mascara brush may be varied at will between a straight configuration and a curved configuration by the user without this requiring the user to come into contact with the mascara brush.

SUMMARY OF THE INVENTION

According to the present invention, a mascara applicator of the type referred to above is characterised in that the shaft and the mascara brush are hollow, that the mascara brush is flexible, that an elongate flexible connector extends within the shaft and the mascara brush, that a first end of the connector is fixed with respect to the distal end of the mascara brush and that the second end of the connector is fixed with respect to actuating means within the grip portion which are selectively operable to move the second end of the connector in the direction away from the mascara brush, thereby applying a force to the distal end of the mascara brush and causing it to adopt a curved configuration.

Thus the mascara brush in accordance with the invention includes an actuator of some sort which is actuable to apply a force to the distal end of the mascara brush via an elongate flexible connector so as to cause the mascara brush to curve. The mascara brush may thus be moved at will between a straight configuration and a curved configuration.

It is necessary for one end of the elongate connector to be fixed with respect to the distal end of the mascara brush and whilst this could be achieved in theory by connecting one end of the connector to the interior of the hollow mascara brush, this is difficult in practice to achieve and it is therefore preferred that the applicator includes an end cap in contact with the distal end of the mascara brush, to which the connector is connected. Tension applied to the elongate connector will therefore be transmitted to the end cap and thus in turn to the distal end of the mascara brush.

Whilst the end cap and the connector may constitute separate components connected together, it is preferred that they constitute a one-piece plastic moulding, e.g. of nylon or the like.

When the tension applied to the connector is released, the mascara brush will return from the curved configuration back to a straight configuration and whilst this may occur solely under the action of the resilient force exerted by the curved mascara brush, this force may in practice be insufficient and it is therefore preferred that the applicator includes a resilient stiffening tab or plate which is integral with the end cap and extends within the mascara brush. Thus when a tension is applied to the connector, this will result not only in the mascara brush adopting a curved configuration but also in the resilient stiffening plate within it adopting a curved configuration also and when the tension is released from the connector the brush will be returned to its straight configuration by the resilient restoring force exerted on it by the curved stiffening plate.

The grip portion, which is preferably constructed, as is usual, in the form of a cap for closing a mascara container in which the shaft and mascara brush are accommodated, when not in use, preferably includes an outer sleeve and an adjustment member which is rotatable with respect thereto, the actuating means being so constructed that rotation of the adjustment member with respect to the outer sleeve results in movement of the second end of the connector in the direction towards or away from the mascara brush. Thus the mascara brush may be moved between the straight and curved configurations simply by rotating the base. In the preferred embodiment, the adjustment member comprises a disc, integral with which is a tube which carries an internal screw thread and is rotatably received within the outer sleeve, the internal screw thread being in mesh with an external screw thread on an actuating member, which is secured against rotation with respect to the tube, the elongate connector being connected to the actuating member, whereby rotation of the disc relative to the outer sleeve results in axial movement of the actuating member within the tube.

In the preferred embodiment, the proximal end of the hollow shaft is integral with a plate, whose periphery is integral with a tubular portion which is snap-fitted within the outer sleeve. This tubular portion preferably defines a well or recess in one end of the grip portion, on whose peripheral wall an internal screw thread is formed for engagement with the external screw thread on a mascara container.

The actuating member may be restrained against rotation with respect to the tube integral with the disc in many ways but in the preferred embodiment the actuating member carries a radial projection which is received in a longitudinally extending recess in the inner surface of the tubular portion, thereby preventing rotation of the actuating member with respect to the outer sleeve.

The "bristles" of the mascara brush may be of conventional type, that is to say in the form of plastic filaments or synthetic fibers connected to the external surface of a tubular carrier, conventionally in tufts, but it is preferred that the bristles are in fact integral with the tubular carrier and thus that the mascara brush comprises a one-piece tubular moulding of polymer material with integral bristles.

Further features and details of the invention will be apparent from the following description of one specific embodiment, which is given by way of example only with reference to the accompanying drawings.

DESCRIPTION OF THE PREFERRED EMBODIMENT

Figure 1:
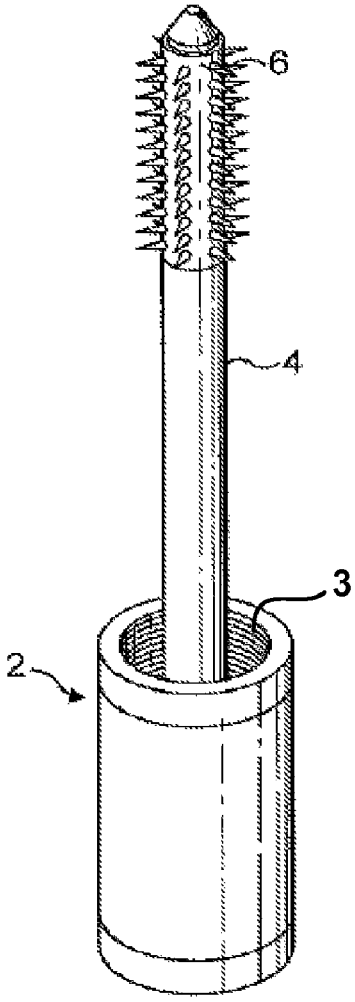
FIG. 1 is a perspective view of a mascara applicator in accordance with the invention.

The illustrated mascara applicator is constructed as the cap of a mascara bottle or container in the conventional manner and since the mascara container itself forms no part of the present invention it will not be described and nor is it shown in the drawings. The applicator comprises a grip portion 2 which defines a recess or well in its uppermost surface as shown in the figures, which is of course normally directed downwardly, when the applicator is connected to a mascara container. The peripheral surface of the well is provided with an internal screw thread 3 for engagement with an external screw thread formed on the neck of a mascara container. Integrally connected to the base of the well is an upstanding shaft 4, at the distal end of which is a mascara brush 6. Thus far the applicator is of course wholly conventional.

The shaft 4 is, however, in this case hollow and defines in its interior an elongate passage. At its upper end, the shaft 4 has an area 10 of reduced diameter, which extends into and engages within a passage 12 within the mascara brush 6, which is therefore also hollow. The mascara brush 6 is a one-piece moulding of plastic material, in this case of synthetic rubber of styrene-ethylene-butylene-styrene type. The "bristles" 14 of the mascara brush 6 therefore form an integral part of it. At the distal end of the mascara brush 6 is an end cap 16, which is formed with a circular boss 18, which also extends into and engages within the passage 12. Asymmetrically integral with the circular boss 18 is an elongate flexible connector 20, which extends through the passage 12 in the mascara brush 6 and also the passage 12 within the hollow shaft 4 and extends into the grip portion 2, as will be described below. Also asymmetrically integral with the circular boss 18 is a spring plate 22, which extends within the passage 12 of the mascara brush 6. The end cap 16, connector or filament 20 and the spring plate 22 constitute a one-piece moulding of tough, resilient plastic material, in this case nylon. The connector 20 and the spring plate 22 are asymmetrically connected to the circular boss 18 such that the connector 20 extends along one side of the passage 12 whilst the spring plate 22 extends along the diametrically opposite side of the passage 12. The spring plate 22 may be in the form of a simple rectangular section plate but it is preferred that whilst one side surface is indeed flat, the other is of part-circular shape such that it sits flush against an inner surface of the passage 12.

Figure 2:
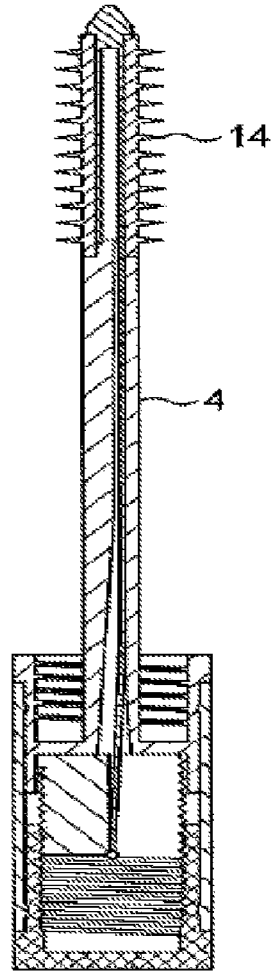
FIG. 2 is an axial sectional view of the applicator of FIG. 1.
Figure 3:
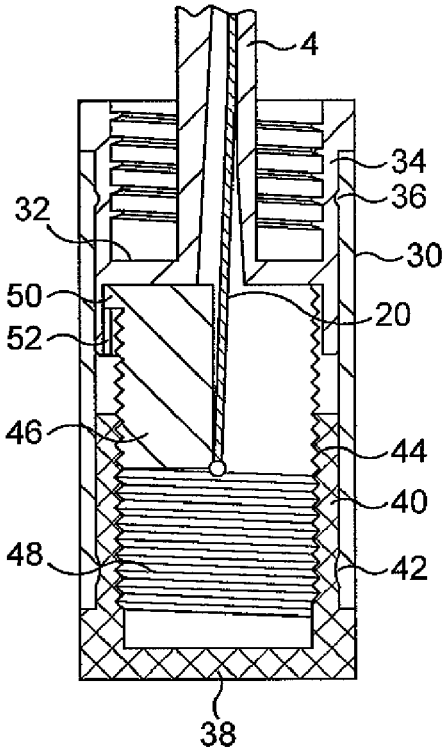
FIG. 3 is an enlarged sectional view of the grip portion of the applicator.

The grip portion comprises an external tubular sleeve 30. Secured to one end of shaft 4 is integral at its lower end with an annular plate 32. Integral with the outer edge of the plate 32 is a tubular portion 34, which extends on both sides of the plate 32. The tubular portion 34 is received within the sleeve 30 and snap-fitted to it by a snap connection, indicated at 36, comprising an integral bead on the internal surface of the sleeve 30, which fits into a complementary annular recess on the outer surface of the tubular portion 34. At the lower end of the sleeve 30, as seen in the drawings, the sleeve 30 is closed by a base comprising an adjustment member in the form of a disc or dial 38, whose external diameter is the same as that of the sleeve 30. Integrally upstanding from the outer edge of the disc 38 is a tubular wall 40, the external diameter of whose upper portion is reduced by an amount equal to the thickness of the sheath 30. The tubular portion 40 of reduced thickness is received within the sheath 30 and connected to it by a further snap-fit connection 42, similar to the snap connection 36. The internal surface of the tubular portion 40 is provided with a screw thread 44. Received within the tubular portion 40 and extending above it is an actuating member 46, which is provided with an external screw thread 48, which is in mesh with the screw thread 44 and the tubular portion 40. At its upper end, the actuating member 46 carries an annular projection or stud 50, which is slidably received within a recess 52 formed in the inner surface of the tubular portion 34, whereby the actuating member 46 is unable to rotate with respect to the tubular portion 34 and is thus unable to rotate also with respect to the sheath 30 and the disc 38. Although the views of FIGS. 2 and 3 are sectional views, the lower portion of the actuating member 46 is shown unsectioned in each case so that the external screw thread 48 on it may clearly be seen.

Figure 7:
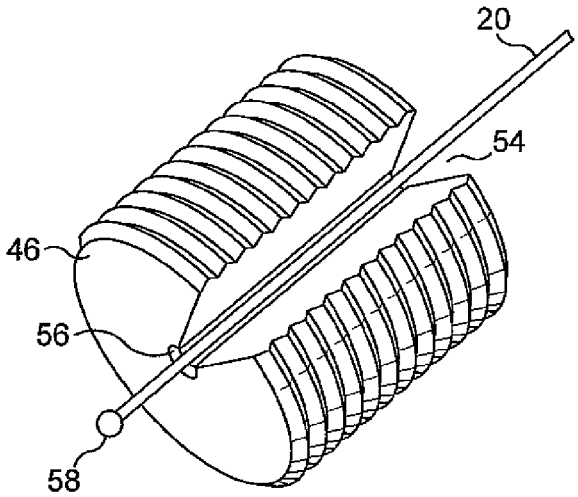
FIG. 7 is a perspective view of the externally threaded actuating member showing the manner in which the elongate connector is fixed in position with respect to it.

As best seen in FIG. 7, the actuating member 46 has a small segmental cut-out 54 formed in it, which extends to the axial centre of the actuating member 46. Formed on the axis of the underside of the actuating member 46 is a hemispherical recess 56. Formed on the associated end of the elongate connector or filament 20 is a spherical ball 58. As may be seen in the drawings, the filament 20 extends within the segmental cut-out 54 and is normally received in the recess 56, whereby movement of the connector 20 relative to the actuating member 46 in the direction towards the mascara brush is prevented.

Figure 4:
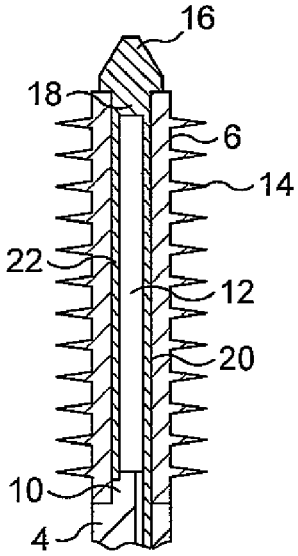
FIG. 4 is an enlarged axial sectional view of the mascara brush.
Figure 5:
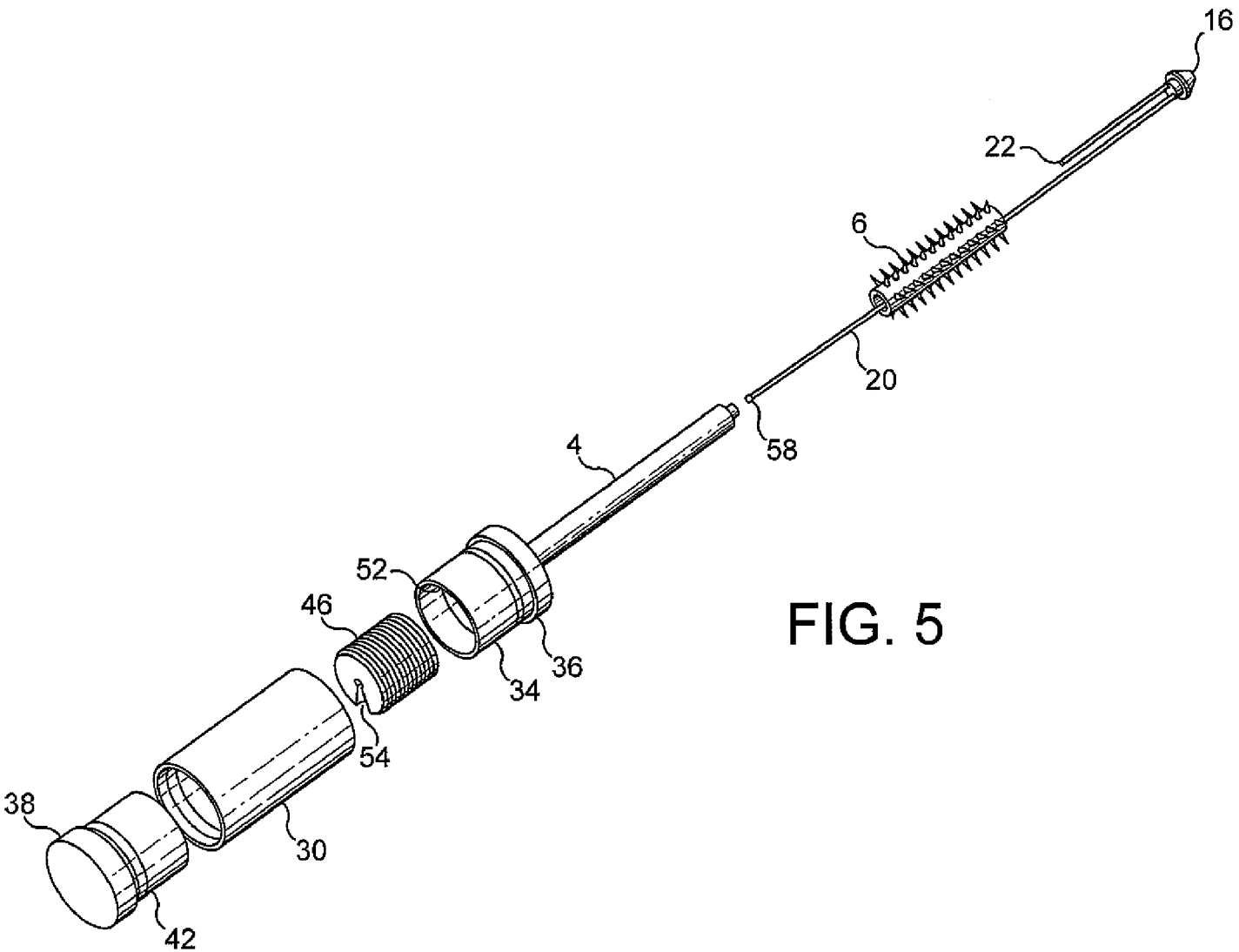
FIG. 5 is an exploded perspective view of the applicator.
Figure 6:
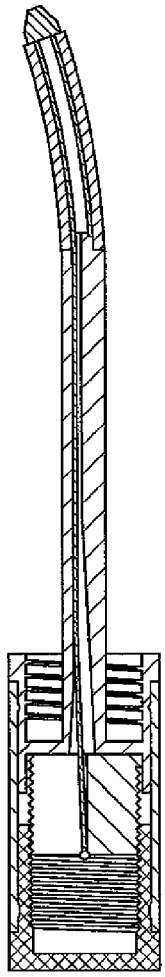
FIG. 6 is an axial sectional view similar to FIG. 2 showing the mascara brush in the curved configuration, from which the bristles have been omitted for the sake of clarity.

In use, the mascara applicator will normally be connected to a mascara container with the brush 6 immersed in liquid mascara. If the user wishes to apply mascara to their eyelashes, the applicator is removed from the container. The brush 6 will normally be in the straight configuration illustrated in FIGS. 1 to 5. Mascara may then be applied to the eyelashes with the brush in the straight configuration. If, however, it is desired to use the brush in a curved configuration, the disc 38 is rotated manually with respect to the sleeve 30. This results of course in rotation of the screw thread 44 on the tubular portion 40 and since the actuating member 46 is constrained against rotation, it is caused to move in the axial direction, that is to say downwardly in the drawings. This downward movement is transmitted to the connector 20 which therefore exerts a downward force on the end cap 16. This downward force is transmitted in turn to the tubular mascara brush and results in its adopting a curved configuration, as shown in FIG. 6. The movement of the mascara brush from the straight configuration to the curved configuration is facilitated by the fact that the connection of the connector 20 to the end cap 16 is asymmetrical. The curvature of the mascara brush will therefore be to the right, as seen in FIG. 4. As the brush 6 is deformed into the curved configuration, the spring plate 20 is also deformed into a curved configuration and maintains the stability of the brush. If it is then desired to return the brush to its original straight configuration, the disc 38 is rotated in the opposite direction, thereby releasing the tension applied to the connector 20. The brush therefore returns to its straight configuration under the action of its own resilience and, more particularly, the resilience of the deformed spring plate 22.

It will be appreciated that numerous modifications may be effected to the embodiment described above and, in particular, that there are numerous ways of applying tension to the connector 20 and that the illustrated example is only one possibility. Whilst the connector 20 is flexible over its entire length in the described embodiment, it will be appreciated that this is not essential and that it may in fact be rigid over much of its length, though it is necessary that that portion of it which extends within the brush 6 is flexible so as to permit it to bend with the brush, when it is moved into the curved configuration.

The invention claimed is:

1. A mascara applicator comprising:

a hollow grip portion having an outer sleeve, the hollow grip portion being connected to one end of a hollow shaft, and the hollow shaft being connected at an another end to a mascara brush;

an elongate flexible connector being extended within the hollow shaft and the mascara brush;

a first end of the elongate flexible connector being fixed to a distal end of the mascara brush and a second end of the elongate flexible connector being fixed to an actuating means within the hollow grip portion, in which the actuating means being selectively operable to move the second end of the elongate flexible connector in a direction away from the mascara brush, such that applying a force to the distal end of the mascara brush causes the distal end of the mascara brush to adopt a curved configuration, wherein the first end of the elongate flexible connector is fixed to the distal end of the mascara brush eccentrically with respect to a center of the mascara brush;

wherein the actuating means having a radial projection in which the actuating means is received in a longitudinally extending recess in an inner surface of a tubular portion of the outer sleeve, thereby preventing rotation of the actuating means with respect to the outer sleeve;

an end cap coupled to the distal end of the mascara brush; and a resilient stiffening plate formed integral with the end cap in which the resilient stiffening plate extends within the mascara brush.

2. An applicator according to claim 1, wherein the elongate flexible connector comprises being connected to the end cap, which is in contact with the distal end of the mascara brush.

3. An applicator according to claim 1, wherein the end cap and the elongate flexible connector comprise a one-piece plastic moulding.

4. An applicator according to claim 1, wherein the resilient stiffening plate is configured to adopt the curved configuration based on the force exerted on the distal end of the elongate flexible connector.

5. An applicator according to claim 1, wherein the grip portion further comprises an adjustment member, which is rotatable with respect to the outer sleeve, the actuating means comprising an internally screw threaded member connected to the adjustment member and in a screw threaded engagement with an externally screw threaded member connected to the second end of the elongate flexible connector, such that rotation of the adjustment member with respect to the outer sleeve results in a movement of the second end of the elongate flexible connector in a direction towards or away from the mascara brush.

6. An applicator according to claim 5, wherein the adjustment member comprises a disc integral with a tube, the tube carrying an internal screw thread and being rotatably received within the outer sleeve, the internal screw thread being in mesh with the external screw thread on the actuating member, which is secured against rotation with respect to the tube, the elongate flexible connector being connected to the actuating member, such that rotation of the disc relative to the outer sleeve results in an axial movement of the actuating member within the tube.

7. An applicator according to claim 5, wherein a proximal end of the hollow shaft comprises being integral with an annular plate, whose periphery is integral with a tubular portion, such that the tubular portion is snap-fitted within the outer sleeve.

8. An applicator according to claim 1, wherein the mascara brush comprises a one-piece tubular moulding of a polymer material with integral bristles.

* * * * *